US006267537B1

(12) United States Patent
Breivik et al.

(10) Patent No.: US 6,267,537 B1
(45) Date of Patent: Jul. 31, 2001

(54) RISER BUNDLE

(75) Inventors: Kare Breivik, Tau; Sigurd Falch, Kolbjomevik; Gunnar Semb, Arendal, all of (NO)

(73) Assignee: Den Norske Stats Oljeselskap A.S. (NO)

( * ) Notice: Subject to any disclaimer, the term of this patent is extended or adjusted under 35 U.S.C. 154(b) by 0 days.

(21) Appl. No.: 09/367,493

(22) PCT Filed: Feb. 16, 1998

(86) PCT No.: PCT/NO98/00049

§ 371 Date: Dec. 23, 1999

§ 102(e) Date: Dec. 23, 1999

(87) PCT Pub. No.: WO98/36150

PCT Pub. Date: Aug. 20, 1998

(30) Foreign Application Priority Data

Feb. 17, 1997 (NO) ..... 970733

(51) Int. Cl.[7] ..... E21B 17/01

(52) U.S. Cl. ..... 405/171; 166/350; 166/367

(58) Field of Search ..... 405/171, 172, 405/173, 169, 170, 158, 154, 224.2; 166/367, 359, 345; 174/101.5; 138/112, 113, 149

(56) References Cited

U.S. PATENT DOCUMENTS

| | | | | |
|---|---|---|---|---|
| 3,605,398 | * | 9/1971 | Carlson et al. | 174/101.5 |
| 4,021,589 | * | 5/1977 | Copley | 428/68 |
| 4,052,862 | * | 10/1977 | Lamy | 405/171 |
| 4,110,554 | * | 8/1978 | Moore et al. | 174/101.5 |
| 4,332,509 | * | 6/1982 | Reynard et al. | 405/168 |
| 4,634,314 | | 1/1987 | Pierce | 405/195 |
| 4,963,420 | * | 10/1990 | Jarrin et al. | 428/36.9 |
| 5,795,102 | * | 8/1998 | Corbishley | 405/171 |

FOREIGN PATENT DOCUMENTS

| | | |
|---|---|---|
| 169687B1 | 2/1988 | (DK) . |
| 0200308A1 | 11/1986 | (EP) . |
| 0424225A1 | 4/1991 | (EP) . |
| 2297337 | 7/1996 | (GB) . |
| 180650 | 10/1997 | (NO) . |
| WO97/06341 | 2/1997 | (WO) . |

* cited by examiner

*Primary Examiner*—David Bagnell
*Assistant Examiner*—Frederick L. Lagman
(74) *Attorney, Agent, or Firm*—Banner & Witcoff, Ltd.

(57) ABSTRACT

A riser bundle comprising a number of risers (2) extending in a wave configuration from the bottom of a body of water up to a floating vessel or the like, the riser bundle (1) along its length being provided with means giving different portions (5, 6 7) along the wave configuration different submerged weight and net buoyancy. The risers (2) are arranged around a centrally extending tube (3) and are surrounded by a tubular outer casing (4), the central tube (3) and the interspaces (8) between the risers (2), along different portions of the wave configuration in operation being filled with materials of different density. Thereby there is achieved at least one light portion (5) of the configuration having a desired positive net buoyancy, and a heavy portion (6 resp. 7) on each side of the light portion (5) having a desired positive submerged weight.

10 Claims, 5 Drawing Sheets

RISER BUNDLE

The invention relates to a riser bundle comprising a number of risers extending in a wave configuration from the bottom of a body of water up to a floating vessel or the like, the riser bundle along its length being provided with means giving different portions along the wave configuration different submerged weight and net buoyancy.

Risers extending between the sea bed and a vessel floating on the surface will not be able to run in a straight line because of the large vertical movements which the vessel has in waves. The risers therefore must be arranged in some geometry allowing the upper end to have large vertical and horizontal movements. During a period of 10–15 seconds the upper end, which is fastened to the vessel, will move approximately ±10 m both vertically and horizontally. In addition, the upper end of the riser during a longer time period will be able to move in the horizontal plane within a circle having a radius of about 10–20% of the ocean depth.

A typical geometry which is used to meet these requirements, is an essentially S-shaped "wave" configuration, as shown in FIG. 1 (wherein the S-shape indeed is shown reversed). In order to cause a riser to float in this manner in the water, it is necessary to give different portions along the riser a different submerged weight and net buoyancy. Along the upper portion or ridge of the "wave" curve the riser will have a positive net buoyancy. This may be achieved in that the riser has a small weight or in that it is equipped with buoyancy bodies in this region. Common practice today is to fasten buoyancy bodies to the riser along this portion. When using several risers simultaneously, these are usually arranged separately in the water, so that each riser must be provided with respective separate buoyancy bodies. This entails that the installation of such risers will be a time-consuming and circumstantial process. In addition, the separate external buoyancy bodies entail that the risers will be subjected to larger wave forces, because of the extra volume of the buoyancy bodies.

It is an object of the invention to provide a riser bundle which is without external buoyancy bodies, so that reduced wave forces are obtained, and which has a structure enabling an economic and rational installation.

Another object of the invention is to provide a riser bundle enabling adjustment of the buoyancy/weight of the riser bundle while it is in operation.

The above-mentioned objects are achieved with a riser bundle of the introductorily stated type which, according to the invention, is characterised in that the risers are arranged around a centrally extending tube and are surrounded by a tubular outer casing, the central tube and the interspaces between the risers, between the central tube and the outer casing, along different portions of the configuration in operation are filled with materials of different density, for achieving at least one light portion of the configuration having a desired positive net buoyancy, and a heavy portion on each side of the light portion having a desired positive submerged weight.

The riser bundle according to the invention will have an approximately constant cross-section area along its whole length, and consequently no cross-sectional increasing buoyancy elements. The desired positive net buoyancy is achieved in that the weight of the riser bundle itself is low along the desired portion of the riser bundle, i.e. in the above-mentioned light portion. The remaining parts of the riser bundle, i.e. on both sides of the ridge (or a ridge) of the wave curve, in operation will have a positive submerged weight. This is achieved in that the riser bundle in operation will contain materials having a large density in said parts, i.e. in. the above-mentioned heavy portions.

The invention will be further described below in so connection with exemplary embodiments with reference to the drawings, wherein FIG. 1 shows a schematic side view of an incomplete riser bundle according to the invention, wherein the outer casing and some of the risers are left out;

In the following the riser bundle according to the invention will be described in connection with the configuration shown in FIG. 1, i.e. the introductorily mentioned, essentially S-shaped wave configuration. As will be clear to a technically skilled person after having read the present description, the riser bundle when required can, however, for example when used on large ocean depths, be constructed so that, in operation, it has more than one wave ridge, i.e. more than one light portion, with an associated heavy portion on each side thereof.

Figure 1:
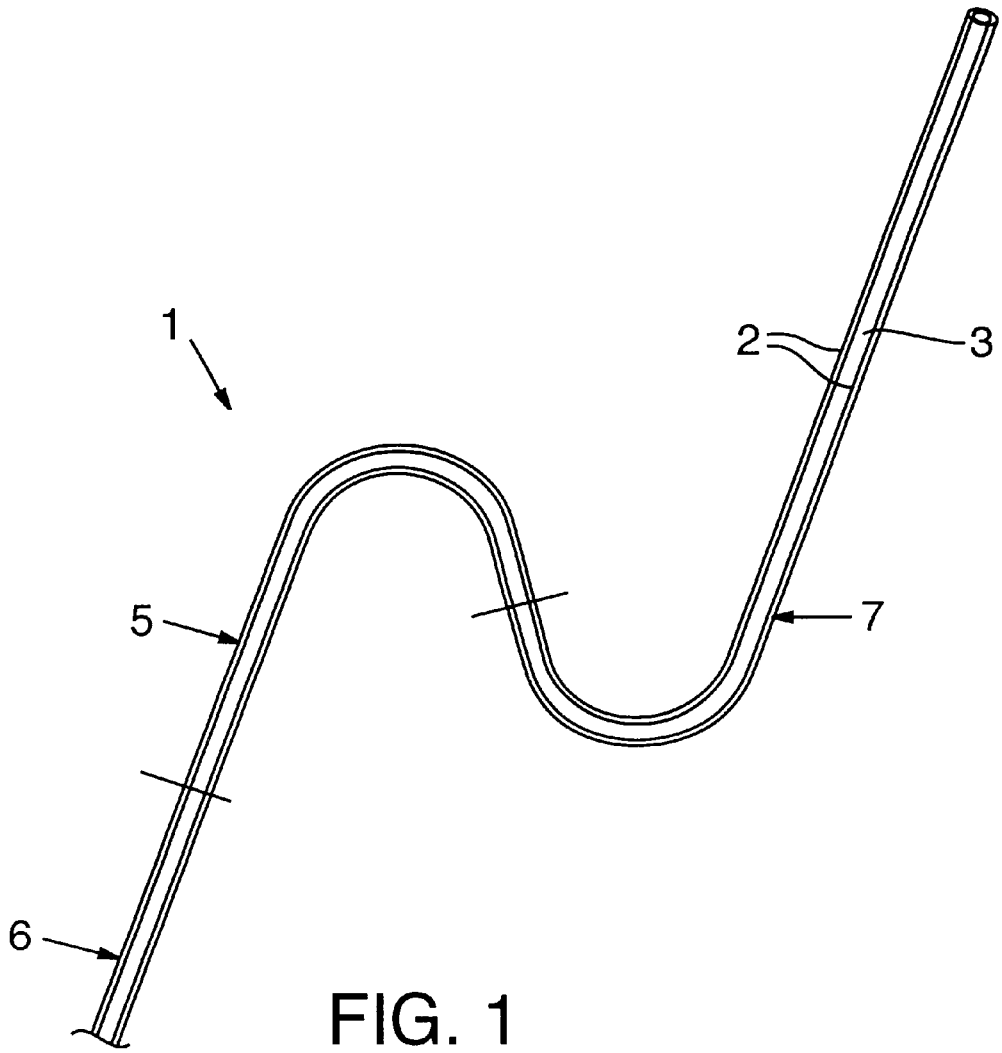
Figure 2:
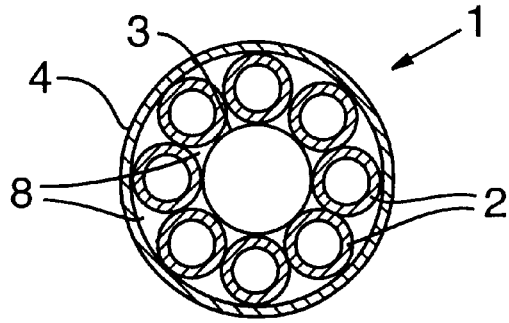
FIG. 2 shows a cross section of an embodiment of a riser bundle.

In the embodiment shown in FIGS. 1 and 2 a riser bundle 1 according to the invention comprises eight risers 2 which are arranged around a centrally extending conduit or tube (centre tube) 3 and which are surrounded by a tubular external casing 4. It is convenient that the risers 2 border on each other and form a ring as shown, and that they also bear against the other side of the inner tube 3 and against the inner side of the outer casing 4, this giving a stable configuration which simultaneously has the necessary flexibility. In order that the riser bundle shall form the intended, essentially S-shaped wave configuration in the water, the "ridge" of the wave curve is designed as a light portion 5, whereas the remaining parts of the riser bundle, on both sides of the ridge of the wave curve, are designed as heavy portions 6 and 7, respectively.

The risers 2 themselves can be such as are in common use today, or they can be manufactured from other materials, such as steel, titanium or composite materials. The centre tube 3 and the tube casing 4 for example can be manufactured from steel or composite materials.

The riser bundle 1 can also contain umbilicals and power cables (not shown) and these possibly can be placed in the interspaces 8 in the risers, between the centre tube and the outer casing 4. It may also be of interest to place the risers 2 in a helical shape around the centre tube.

Figure 3:
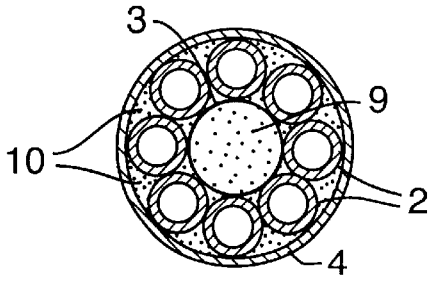
FIG. 3 shows a cross section of the riser bundle according to FIG. 2 in a light portion thereof.

The weight, and therewith the net buoyancy, of the riser bundle varies along the length of the bundle as a result of the fact that the centre tube contains materials of different density/weight in the above-mentioned light and heavy portions. Similarly, the interspaces 8 between the risers will be filled with materials having a different density/weight. A cross section of the light portion 5 of the riser bundle, wherein there is wanted a positive net buoyancy of a certain magnitude, is shown in FIG. 3. The centre tube 3 here is shown to be filled with a light foam material 9. The light portion can, however, also be air-filled. In this case the light portion will be terminated by means of suitable end walls in the centre tube. The interspaces 8 (see FIG. 2), are also filled with a foam material 10 of low density.

Figure 4:
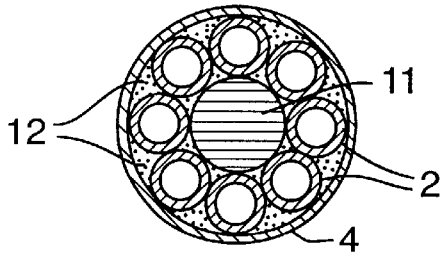
FIG. 4 shows a cross section of the riser bundle according to FIG. 2 in a heavy portion thereof.

A cross section of a heavy portion 6 or 7 of the riser bundle, wherein this is to have a desired positive submerged weight, is shown i FIG. 4. The centre tube 3 here will be filled with water 11 when the riser bundle is ready installed, whereas it is filled with air before the installation. The riser bundles 2 themselves before the installation will be air-filled, whereas in operation they will contain the topical medium which is to be transported, i.e. oil, gas or water. The interspaces 8 are filled with a material 12 having a density which is adapted in such a manner that the ready installed riser bundle with water-filled centre tube and operating medium in the risers has the desired submerged weight, whereas the riser bundle with air-filled centre tube and air-filled risers will have a positive net buoyancy. The material in the interspaces in these heavy portions for example may be a heavy foam which is possibly mixed with sand or iron particles to achieve the desired density/volume weight.

Figure 5:
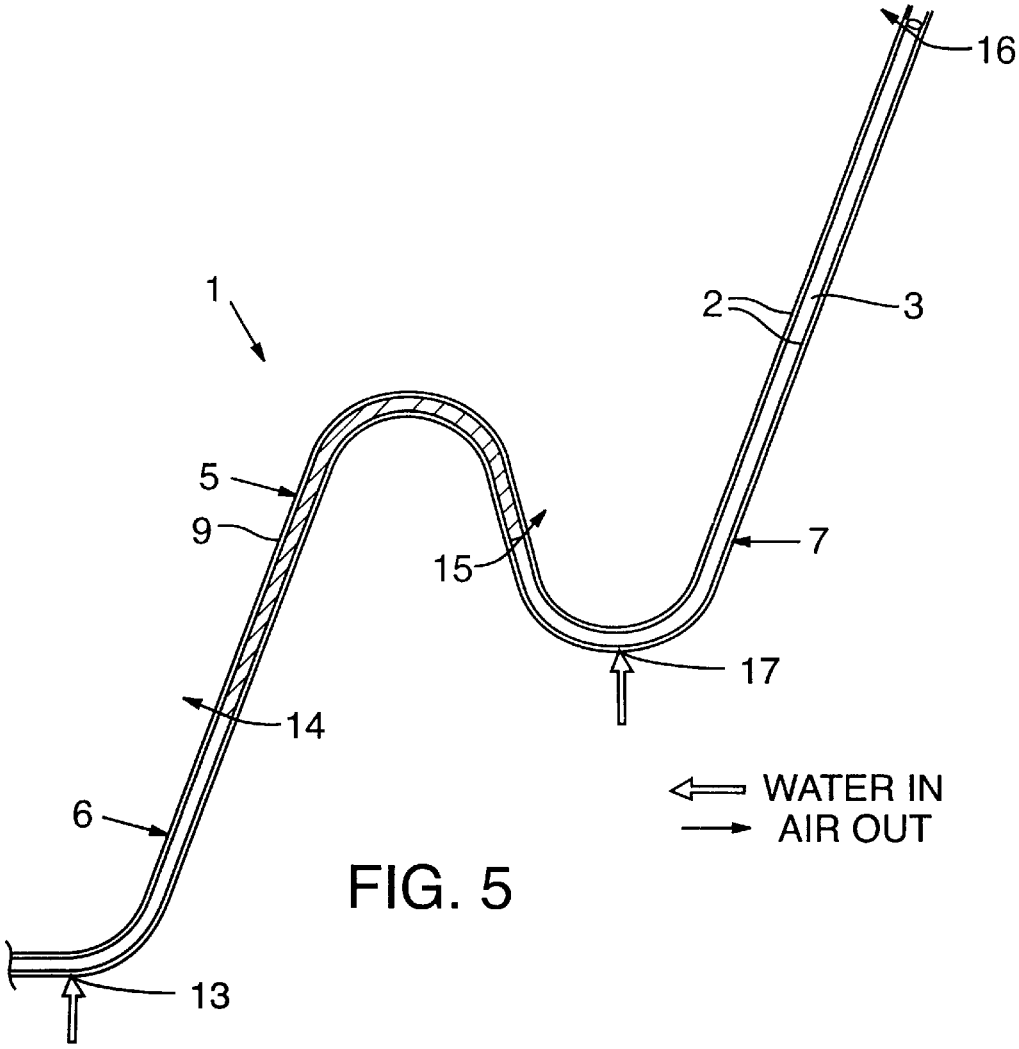
FIG. 5 shows a side view corresponding to that of FIG. 1, but shown with the central tube partly in a longitudinal section and with connection points for filling of water and discharge of air.

FIG. 5 shows the riser bundle 1 in the same configuration as in FIG. 1, but the centre tube 3 is shown axially sectioned in the light portion 5, and there are further shown connection points for filling of water and discharge of air. These connection points are only symbolized by arrows, but will be in the form of suitable valves. Thus, the centre tube 3 at each end of each of the heavy portions 6 and 7, respectively, is provided with respective valve means 13, 14 and 15, 16, to allow filling of water and discharge of air. More specifically, the lowermost one 6 of the heavy portions at the lower end has a valve 13 for filling of water, and at the upper end a valve 14 for discharge of air, whereas the uppermost one 7 of the heavy portions at each end has a valve 15 and 16, respectively, for discharge of air. Further, this heavy portion 7 also has a valve 17 for water filling at the place of this portion which is situated lowermost when the riser bundle is ready installed. The centre tube 3 in other respects are closed at each end of the riser bundle.

Figure 6:
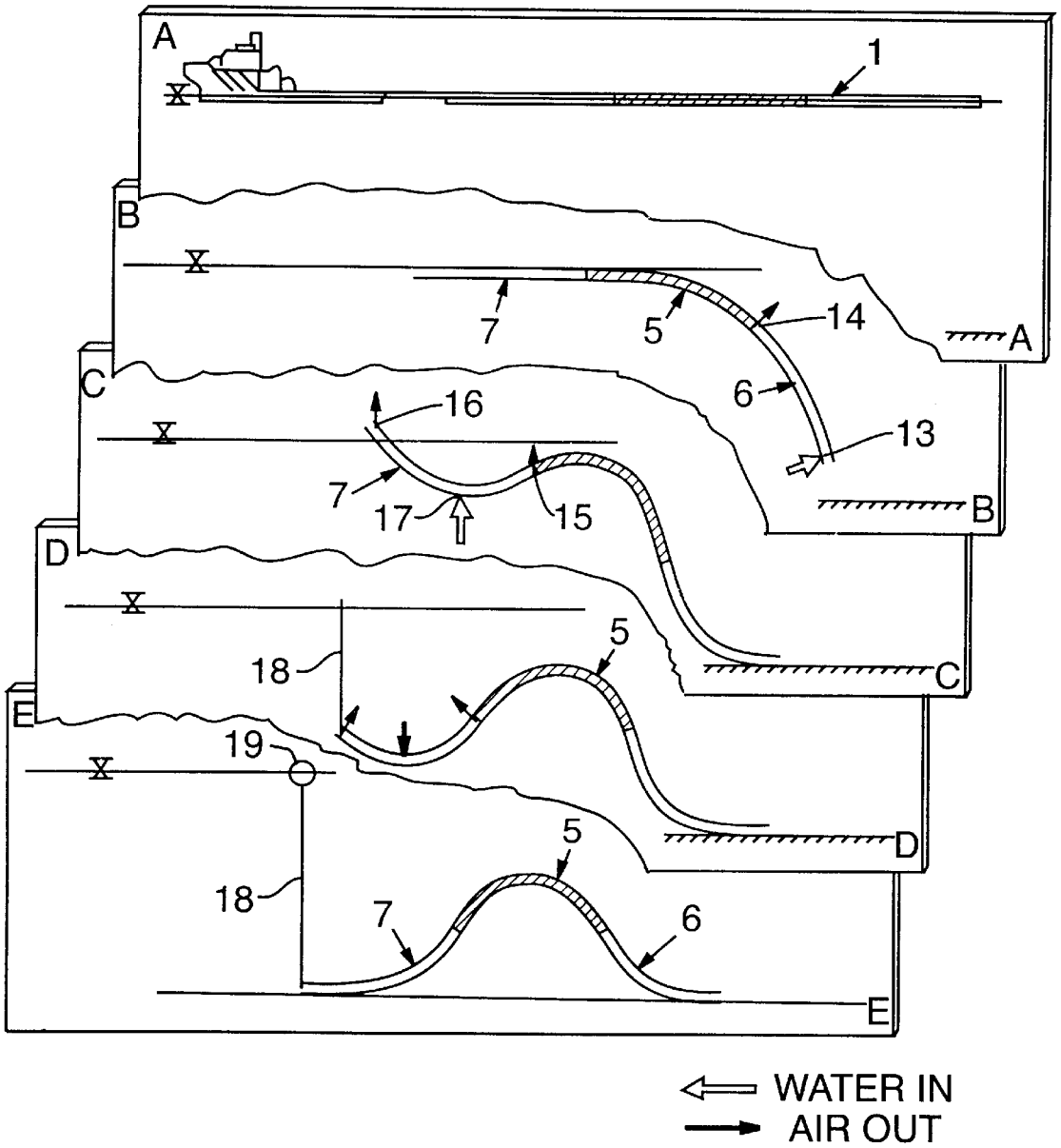
FIG. 6 shows different phases of installation of a riser bundle according to the invention.
Figure 7:
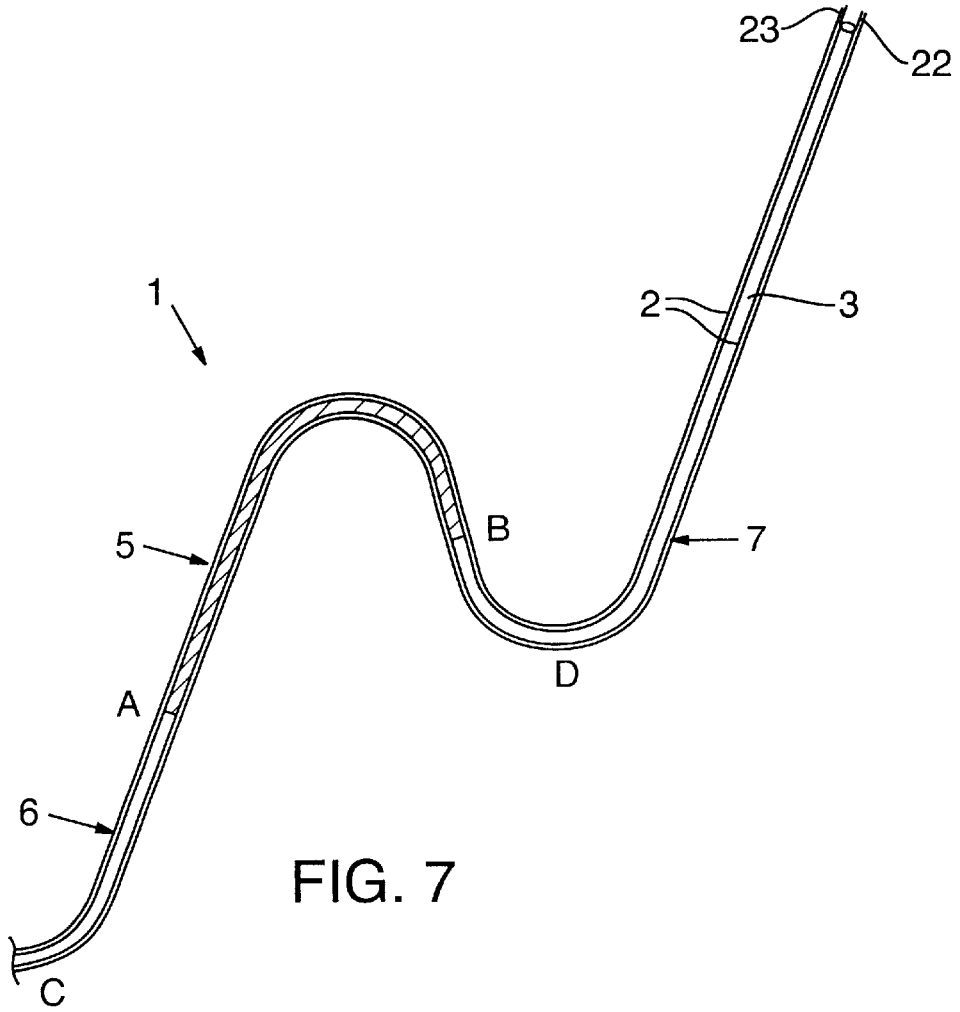
FIG. 7 shows a side view corresponding to that of FIG. 5, of a modified embodiment which is provided with means for adjusting the buoyancy/weight of the riser bundle during operation.
Figure 8:
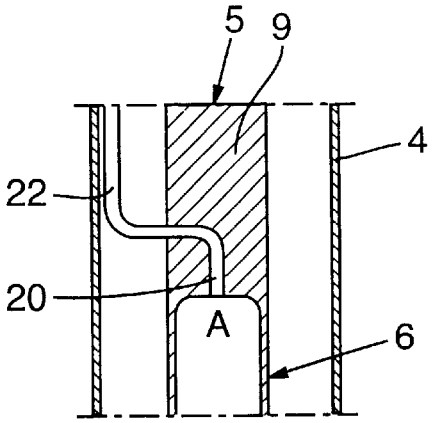
FIGS. 8 and 9 show partial longitudinal sections of the riser bundle in the regions A and B, respectively, in FIG. 7.
Figure 9:
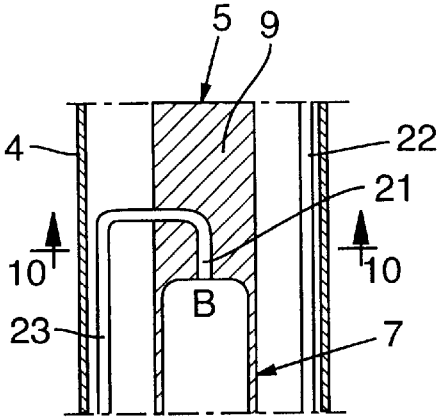
Figure 10:
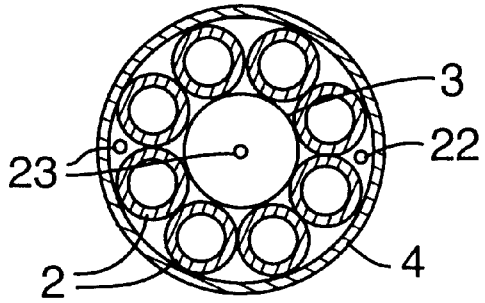
FIG. 10 shows a cross section along the line X—X in s FIG. 9.

Installation of a riser bundle according to the invention, which in operation is to have a typical "lazy wave" configuration as shown in FIG. 5, will be described below with reference to FIG. 6.

Initially, the centre tube and the heavy portions of the riser bundle are filled with air at the same time as the risers also are air-filled, and the entire riser bundle then will have a positive net buoyancy. The riser bundle then will float on the sea surface, so that it can be towed to the field where it is to be installed. This is a substantial advantage as compared to the prior art, wherein the risers must be transported in coiled form on a large laying vessel. When the riser bundle has been towed to the place where it is to be installed (FIG. 6A), the installation proper is carried out in the following steps:

1) The lower heavy portion is filled slowly with water which is taken in through the lower valve 13, whereas air is let out through the upper valve 14. The lower part of the riser bundle will start sinking (FIG. 6B).
2) When the lower end of the riser bundle has reached the sea bed, it is connected to the pipeline which is already lying there. In some cases, dependent on the configuration, it will be necessary to fill some water also in the upper heavy portion, as described in step 3 below. In some configurations it will be of interest to have a tension at the lowermost end of the riser bundle when it is ready installed. In such a case it will be necessary to pull the lower end of the riser bundle down to the connection point at the sea bed with a wire or by means of a lump weight.
3) When the lower heavy portion of the riser bundle is filled with water, and the lower end possibly is connected at the sea bed, the upper heavy portion is slowly filled with water. Water is taken in through the intermediate valve 17, whereas air is let out through the valves 15, 16 at each end of the upper portion (Fig, 6C).
4) When the filling of the upper heavy portion has come to a certain point, the entire riser bundle inclusive of the upper end will sink under water. A towing/lifting wire 18 which is fastened to the upper end, is used to lower the upper end down in the water while the filling with water is completed (FIG. 6D).
5) The upper end of the riser is lowered by means of the lifting wire 18 and placed at the sea bed. A marking buoy 19 can now possibly be fastened to the lifting wire (FIG. 6E).
6) When the topical vessel (tanker) arrives at the field, the marking buoy is picked up, and the upper end of the riser is hoisted up and coupled to the vessel in a conventional manner. If the vessel is already In place when the installation is carried out, step 5 above may be omitted.
7) When the field is put into operation, the risers are filled with the respective operating media (oil, gas and/or water), and the riser bundle then will get the final, desired distribution of weight and buoyancy.

A modified embodiment of the riser bundle 1, wherein it is possible to adjust the buoyancy/weight of the riser bundle while it is in operation, is shown in FIGS. 7–10. Such an adjustment for example can be of interest if the liquid/gas ratio in the risers changes.

In this embodiment the centre tube 3 at A and B, i.e. at each end of the heavy portions 6, 7 adjacent to the light portion 5, has an outlet 20 and 21, respectively, which is connected to a respective pressure hose 22 and 23 extending within the riser bundle 1 up to the upper end thereof. Such as appears, the pressure hoses have a small diameter in relation to the risers 2, so that they can be laid in respective interspaces between the risers and the outer casing 4.

During installation, air is let out through these hoses in the same manner as previously described. After the installation is finished and the riser bundle has been coupled to the vessel, it will be possible to connect the pressure hoses to a pneumatic unit or the like on the vessel. By pumping in compressed air It will then be possible to press water downwards from A and B, so that the weight is reduced and the net buoyancy increases in this region. The water is let out through the valves 13 and 17 (FIG. 5) at C and D, which have been open since the installation and will be open all the time. There is neither any need to open or close valves at A and B in the operating period. All control takes place on board the vessel. Monitoring can take place either by means of a sensor measuring the water level within the centre tube, or by an external measurement of the position of the bundle.

Figure 11:
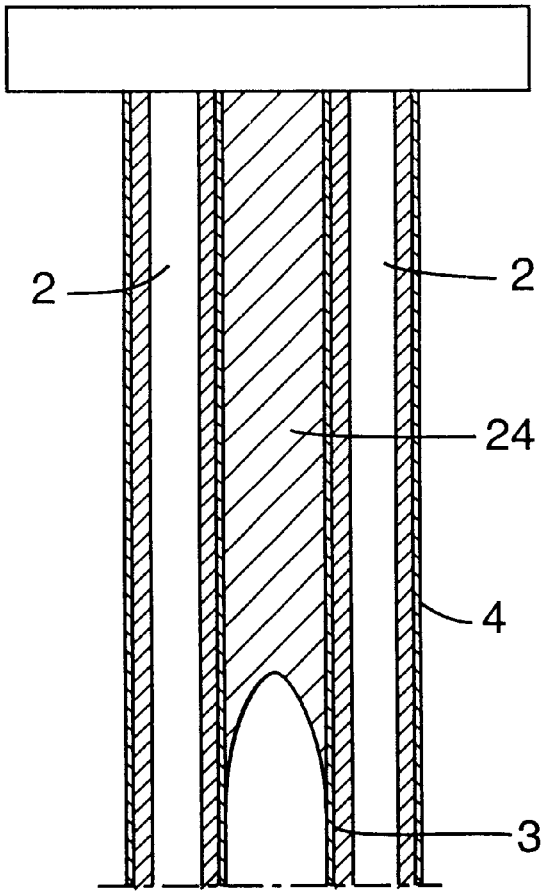
FIG. 11 shows an axial longitudinal section of an upper end portion of a riser bundle according to the invention, wherein a buoy stiffener is placed in the central tube.

The riser bundle according to the invention also gives the possibility to use an internal buoy stiffener. FIG. 11 shows such an embodiment wherein an internal buoy stiffener 24 is placed at the upper end of the centre tube 3.

What is claimed is:

1. A riser bundle comprising a number of risers (2) extending in a wave configuration from the bottom of a body of water up to a floating structure, the riser bundle (1) along its length being provided with means giving different portions (5, 6, 7) along the wave configuration different submerged weight and net buoyancy, characterized in that the risers (2) are arranged around a centrally extending tube (3) and are surrounded by a tubular outer casing (4), the central tube (3) and the interspaces (8) between the risers (2), between the central tube (3) and the outer casing (4), along different portions of the wave configuration in operation being filled with materials of different density, for achieving at least one light portion (5) of the configuration having a desired positive net buoyancy, and a heavy portion (6 resp. 7) on each side of the light portion (5) having a desired positive submerged weight.

2. A riser bundle according to claim 1, characterized in that the central tube (3) and said interspaces (8) in the light portion (5) are filled with a foam material (9 resp. 10) of low density.

3. A riser bundle according to claim 1, characterized in that the central tube (3) in the light portion (5) is air-filled.

4. A riser bundle according to claim 3, characterized in that the central tube (3) in the heavy portions (6, 7) is arranged to be filled with water (11), and that the interspaces (8) in the heavy portions (6, 7) are filled with a material (12) having density which is adapted so that the riser bundle (1) in installed condition with water-filled central tube (3) and operating medium in the risers (2) has the desired submerged weight, whereas the riser bundle (1) with air-filled central tube (3) and with air-filled risers (2) will have a positive net buoyancy.

5. A riser bundle according to claim 4, characterized in that the central tube (3) at each end of each of the heavy portions (6, 7) is provided with a valve means (13, 14, reap. 15, 16) to allow filling of water or discharge of water or air, and that the central tube (3) in the heavy portion (7) which in operation constitutes the uppermost one of the heavy portions (6, 7), also is provided with a valve means (17) at the place of this portion which is situated lowermost when the riser bundle (1) is ready installed.

6. A riser bundle according to claim 5, characterized in that the central tube (3) at each end of ae heavy portions (6, 7) which adjoin the light portion (5), has an outlet (20 resp. 21) which is connected to a pressure hose (22 resp. 23) extending up to the upper end of the riser bundle (1), the pressure hose (22, 23) at the upper end being arranged to be connected to a compressed-air source.

7. A riser bundle according to any one of claims 1, 2 and 3, characterized in that said interspaces (8) in the heavy portions (6, 7) are filled with a heavy foam (12).

8. A riser bundle according to claims, characterized in that the heavy foam (12) is mixed with sand or particles of metal.

9. A riser bundle according to any one of claims 1, 2 and 3, characterized in that the risers (2) are laid in a helical shape around the central tube (3).

10. A riser bundle according to any one of claims 1, 2 and 3, characterized in that umbilicals or power cables are arranged in the interspaces (8) between the risers (2).

* * * * *